US008672771B1

(12) United States Patent
Vlosich

(10) Patent No.: US 8,672,771 B1
(45) **Date of Patent: *Mar. 18, 2014**

(54) RIGHT OR LEFT HANDED PUTTER WITH NEGATIVE LOFT

(71) Applicant: Richard Vlosich, Prescott Valley, AZ (US)

(72) Inventor: Richard Vlosich, Prescott Valley, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/036,383

(22) Filed: Sep. 25, 2013

(51) Int. Cl.
*A63B 69/36* (2006.01)
*A63B 53/04* (2006.01)
*A63B 53/06* (2006.01)

(52) U.S. Cl.
USPC ..... 473/251; 473/314; 473/335; 473/336; 473/340; 473/341; 473/313; 473/325

(58) Field of Classification Search
USPC ..... 473/251–256, 313, 314, 349, 325, 473/334–341; D21/736–746
See application file for complete search history.

(56) References Cited

U.S. PATENT DOCUMENTS

| | | | | | |
|---|---|---|---|---|---|
| RE19,178 | E | * | 5/1934 | Spiker | 473/251 |
| 3,085,804 | A | | 4/1963 | Pieper | |
| 4,010,958 | A | | 3/1977 | Long | |
| 4,664,385 | A | * | 5/1987 | Macera | 473/340 |
| 4,795,158 | A | * | 1/1989 | Kuykendall | 473/201 |
| 4,962,932 | A | * | 10/1990 | Anderson | 473/336 |
| 5,344,149 | A | * | 9/1994 | Miller | 473/341 |
| 5,601,500 | A | * | 2/1997 | Shipley | 473/314 |
| 5,857,922 | A | * | 1/1999 | Delio | 473/313 |
| 5,976,025 | A | | 11/1999 | Williams | |
| 6,102,814 | A | * | 8/2000 | Grace et al. | 473/340 |
| 6,328,662 | B1 | * | 12/2001 | Huang | 473/334 |
| 6,440,006 | B1 | | 8/2002 | Johnson | |
| 6,695,708 | B2 | | 2/2004 | Fisher | |
| 2002/0098908 | A1 | * | 7/2002 | James et al. | 473/324 |

* cited by examiner

*Primary Examiner* — Sebastiano Passaniti
(74) *Attorney, Agent, or Firm* — Weiss & Moy, P.C.; Veronica-Adele R. Cao

(57) ABSTRACT

A golf putter having a head with a negative loft angle on the two ball striking surfaces, heel, and toe surfaces. The overall weight of the putter may be adjusted and the center of gravity of the putter may be shifted laterally as desired with removable weights that are coupled to the putter head.

13 Claims, 1 Drawing Sheet

RIGHT OR LEFT HANDED PUTTER WITH NEGATIVE LOFT

CROSS-REFERENCE TO RELATED APPLICATION

This application is a continuation-in-part of U.S. patent application Ser. No. 13/102,004 filed on May 5, 2011 in the name of Richard Vlosieh, to which priority is claimed.

TECHNICAL FIELD

The present application generally relates to a golf club, and more specifically, to a putter with negative loft. The putter of the present invention may be used as either a right handed or left handed putter.

BACKGROUND

A golfer selects a golf club according to several factors such as the distance of the ball from the hole, the lie of the ball, the slope of the grass, and even the wind direction and speed. When a golf ball is on the green (i.e. the putting surface of a golf course), the ball sits slightly down in the grass. Loft (i.e. the angle of the clubface from vertical) is sometimes needed to lift the ball out of the grass and cause the ball to roll. The loft built into some commonly used putters is typically within the range of 2.5 to 4 degrees. This loft is considered positive loft because the angles are greater than zero.

Putters with a positive loft, have a center of gravity below the equator or center of the golf ball, which contributes to the loft that occurs when the clubface impacts the ball. While loft may be beneficial during some putts, loft may be detrimental during others. Furthermore, when a putter with positive loft impacts the golf ball, it imparts immediate backspin upon the ball and then later the golf ball starts its forward roll. More force is therefore required to make the golf ball travel the desired distance. This immediate backspin and subsequent forward roll may also cause the golf ball to change direction during its roll. The present invention discloses a golf putter with negative loft. Negative loft on the ball striking surface of the putter head causes the putter to impact the golf ball above its equator/center, thereby imparting topspin upon the golf ball. The topspin will cause the golf ball to roll more and will also prevent the golf ball from being lofted upon impact during a putt. The putter head of the present invention also has a center of gravity above the equator/center of the golf ball, which helps to roll the ball.

Golf clubs, including putters, are usually designed exclusively for either a right handed player or a left handed player. As disclosed herein, both faces of the putter may have negative loft, so that the putter may be used by both right handed and left handed players.

SUMMARY

This summary is provided to introduce a selection of concepts in a simplified form that are further described below in the DESCRIPTION OF THE DISCLOSURE. This summary is not intended to identify key features of the claimed subject matter, nor is it intended to be used as an aid in determining the scope of the claimed subject matter.

In accordance with another embodiment of the present invention, a golf putter head is disclosed. The golf putter head comprises: two ball striking surfaces with negative loft; a toe surface with negative loft; and a heel surface with negative loft, wherein each of the two ball striking surfaces, the toe surface, and the heel surface have a trapezoidal shape.

In accordance with another embodiment of the present invention, a golf putter head is disclosed. The golf putter head comprises: two ball striking surfaces, each having a loft angle between −1° and −4°; a toe surface having a loft angle between −20° and −35°; and a heel surface having a loft angle between −20° and −35°.

In accordance with another embodiment of the present invention, a golf putter head is disclosed. The golf putter head comprises: two ball striking surfaces, each having a loft angle between −1° and −4°; a toe surface having a loft angle between −20° and −35°; a heel surface having a loft angle between −20° and −35°; a threaded aperture within the toe surface for receiving a threaded weight; and a threaded aperture within the heel surface for receiving a threaded weight, wherein the putter has a center of gravity above a center of a golf ball.

The features, functions, and advantages may be achieved independently in various embodiments of the disclosure or may be combined in yet other embodiments.

BRIEF DESCRIPTION OF THE DRAWINGS

The novel features believed to be characteristic of the application are set forth in the appended claims. In the descriptions that follow, like parts are marked throughout the specification and drawings with the same numerals, respectively. The drawing figures are not necessarily drawn to scale and certain figures can be shown in exaggerated or generalized form in the interest of clarity and conciseness. The application itself, however, as well as a preferred mode of use, further objectives and advantages thereof, will be best understood by reference to the following detailed description of illustrative embodiments when read in conjunction with the accompanying drawings, wherein:

DESCRIPTION OF THE APPLICATION

Figure 1C:
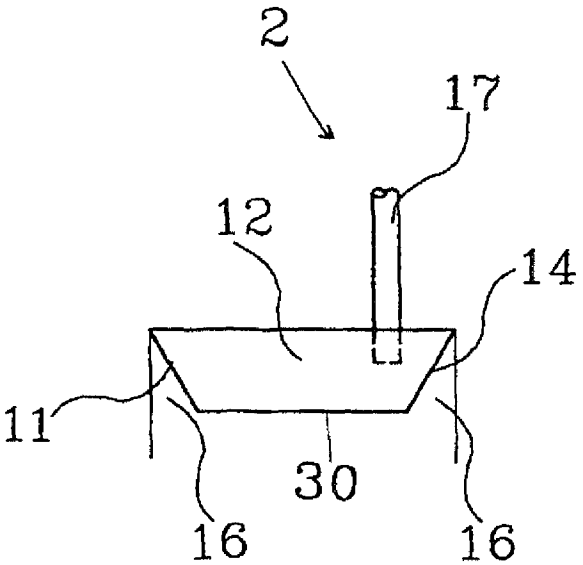
FIG. 1C is a view of a golf putter with the putter head of FIG. 1A, showing a shaft and a ball striking surface of the putter head.

The description set forth below in connection with the appended drawings is intended as a description of presently preferred embodiments of the application and is not intended to represent the only forms in which the present application can be constructed and/or utilized. The description sets forth the functions and the sequence of steps for constructing and operating the application in connection with the illustrated embodiments. It is to be understood, however, that the same or equivalent functions and sequences can be accomplished by different embodiments that are also intended to be encompassed within the spirit and scope of this application. The following reference numerals are used with the accompanying drawings: Golf putter 2; head 4; weight 6; putter shaft hole 10; toe surface 11; ball striking surface 12; ball aiming symbol 13; heel surface 14; apertures in the toe surface and heel surfaces 15; loft angle 16; shaft 17; top 20 of the putter head; and base 30 of the putter head.

Figure 1B:
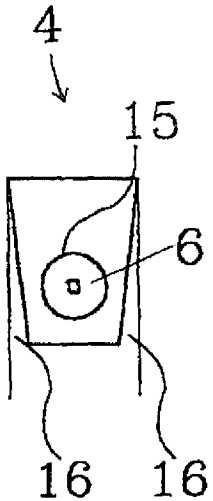
FIG. 1B is a rear view of the putter head of FIG. 1A, showing the heel surface of the putter head. A weight is shown coupled within the aperture within the heel surface.
Figure 1A:
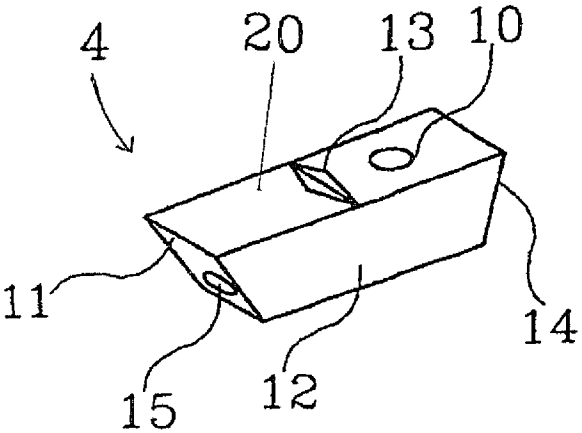
FIG. 1A is a perspective view of a golf putter head having a negative loft angle, in accordance with one or more embodiments of the present invention. An aperture within the toe surface is shown empty.

FIGS. 1A-1C together show a golf putter 2 with a putter head 4 in accordance with one or more embodiments of the present invention. In its simplest form, the golf putter 2 comprises a head 4, a shaft 17 coupled to a putter shaft hole 10 in the head 4, and a grip (not shown) coupled to a proximal end of the shaft 17.

One embodiment of the putter head 4 of the present invention is illustrated in FIG. 1A (top view) and FIG. 1C (right side view). The putter head 4 may have a metal aluminum, or wooden body. The dimensions of the putter head 4 may vary. The top 20 of the head 4 may be between approximately 0.5 inch-1.5 inches wide, the base 30 of the head 4 may be between approximately 0.5 inch to 1 inch wide, the height of the head 4 may be between approximately 1 inch-1.25 inches, and the length of the head 4 may be between approximately 3.75 inches-4.5 inches. For example, the top 20 of the head 4 may be approximately 1.5 inches wide, the base 30 of the head 4 may be approximately ⅝ inch wide, the height of the head 4 may be 1.5 inches, and the length of the head 4 may be 4.5 inches long. It should be clearly understood that substantial benefit may still be derived from a putter head 4 having alternative dimensions. As shown in FIG. 1B, the width of the base 30 of the head 4 would be smaller than the width of the top 20 of the head 4 due to the negative loft angles 16 of the two ball striking surfaces 12.

As shown in FIG. 1B, the head 4 may have two ball striking surfaces 12 positioned on either side of the head 4, which allows the putter 2 to be universally used by either right handed or left handed players. The left handed surface may be a mirror image of the right handed surface. The two ball striking surfaces 12 may be trapezoidal in shape (see FIG. 1C), however it should be clearly understood that substantial benefit may be derived from an alternative suitable shape. A negative loft angle 16 is cut into the ball striking surfaces 12 at predetermined negative loft angles 16. For example, the ball striking surfaces 12 may each have a loft angle 16 of between approximately −1° and −4°. If the shaft 17 is held by a golfer at vertical (or 0°), without any forward press, when the putter head 4 impacts the golf ball, then a putter head 4 having ball striking surfaces 12 with a −3° loft angle 16 will strike the golf ball approximately 0.044 inch above the equator/center of the golf ball. This will result in topspin being imposed on the ball immediately upon impact and will also prevent the golf ball from being lofted, both of which would lessen the amount of force required to putt the golf ball over a desired distance. If the putter head 4 has ball striking surfaces 12 with a −4° loft angle 16, then the ball striking surfaces 12 will strike the golf ball approximately 0.066 inch above the equator/center line of the golf ball if the shaft 17 is held by the golfer at vertical (or 0°) when the putter head 4 impacts the golf ball. However, if the ball striking surfaces 12 have a loft angle 16 that is more negative than −4° (e.g. −5°), then the golf ball will be pressed or squeezed into the grass upon impact, thereby hindering its forward roll. Although it is preferred that the striking surfaces 12 have a loft angle 16 of approximately −3°, it should be clearly understood that substantial benefit may be derived from any suitable negative loft angle 16 that will prevent loft and impart unhindered topspin on the golf ball upon impact without pressing or squeezing the golf ball into the grass.

The putter 2 may also have a toe surface 11 and a heel surface 14, each having a negative loft angle 16, to make the center of gravity of the head 4 to be at a point above the center of the height of the head 4. The toe surface 11 and the heel surface 14 may also be trapezoidal in shape (see FIGS. 1A and 1B), however it should be clearly understood that substantial benefit may be derived from an alternative suitable shape. In relation to the golf ball, the center of gravity of the putter head 4 may be approximately 0.02 inch above the equator/center of the golf ball or higher depending upon the loft angle 16 of the heel surface 14 and the toe surface 11. Moving the center of gravity of the head 4 in this manner allows the center of gravity to strike the golf ball above the equator/center line of the golf ball, similar to the way the ball striking surfaces 12 having a −3° loft angle 16 does, thereby imposing immediate topspin on the golf ball and preventing loft of the golf ball upon impact. The heel surface 14 and the toe surface 11 may each have a loft angle 16 of between approximately −20° and −35°. Although it is preferred that the heel surface 14 and the toe surface 11 of the head 4 have loft angles 16 of approximately −30°, it should be clearly understood that substantial benefit may be derived from the heel surface 14 and the toe surface 11 having any suitable negative loft angle 16 that will cause the center of gravity to be above the center of the height of the putter head 4.

In one embodiment of the present invention, all four surfaces of the head 4 may have a negative loft angle 16. For example, the two opposing ball striking surfaces 12 may both have a loft angle 16 of −3° and the toe surface 11 and the heel surface 14 may both have a loft angle 16 of −30°. While in this example, the toe surface 11 and the heel surface 14 have the same loft angle 16, substantial benefit may also be derived if the toe surface 11 and the heel surface 14 have a different loft angle 16. For example, the two opposing ball striking surfaces 12 may both have a loft angle 16 of −2°, the toe surface 11 may have a loft angle 16 of −20°, and the heel surface 14 may have a loft angle 16 of −25°. This type of configuration may be preferable for an individual who wishes for the golf putter 2 to be toe-weighted; i.e. the weight of the putter 2 is heavier at the toe of the putter head 4, which helps decrease club twisting which can result from a miss-hit off the toe of the putter head 4. As a further example, if a golfer wishes for the golf putter 2 to be heel-weighted; i.e. the weight of the putter 2 is heavier at the heel of the putter head 4, then the toe surface 11 may have a loft angle 16 of −25°, and the heel surface 14 may have a loft angle 16 of −20°.

A golfer may sometimes wish to change the weight of his/her putter 2 to adjust for certain conditions on the green. For example, on a green that may be wet from rain or on a longer green a user may wish to have a heavier putter 2. According to one embodiment of the present invention, the head 4 may have apertures 15 formed in the toe surface 11 (see FIG. 1A) and the heel surface 14 (see FIG. 1B). The apertures 15 may be threaded and may be approximately ⅜ inch in depth or any other suitable depth. In another embodiment, the two apertures 15 might together form a through hole that extends completely through the length of the head 4. As shown in FIGS. 1A and 1B, the threaded apertures 15 may each have a completely enclosed perimeter. The threaded apertures 15 may be left empty in order to maintain the original weight of the putter 2 (see FIG. 1A) or, alternatively, weights 6 may be inserted into the threaded apertures 15 in order to shift the center of gravity laterally while maintaining the center of gravity at a point above the center of the height of the putter head 4 (see FIG. 1B). The weights 6 are only used to adjust the center of gravity toward the heel surface 14 or toward the toe surface 11; the center of gravity will remain at a point above the center of the height of the putter head 4 regardless of the adjustments made with the weights 6. A weight 6 may be made of tungsten, or any other suitable material, and may have a threaded body that will engage a threaded aperture 15 when screwed in. It should be clearly understood, however, that further substantial benefit may be derived from an alternative connection means between the aperture 15 and the weight 6, as long as the weight 6 may be securely coupled, as well as removably coupled, within the aperture 15. The length of the threaded body of the weight 6 would be similar to (or shorter than) the length of the threaded aperture 15 and the diameter of the threaded body of the weight 6 would be similar to the diameter of the threaded aperture 15 so that they will mate properly. The weight 6 may be screwed in manually or the weight 6 may have an indentation in its body to receive an alien wrench or screwdriver head so that it may be screwed in with a tool (see FIG. 1B). The weights 6 may be made of plastic or some other suitable lightweight material that weighs next to nothing, thereby covering up the threaded apertures 15 while staying close to the original weight of the putter 2. The weights 6 may also vary from between approximately 4 grams to 12 grams.

The two weights 6 may be identical (e.g. a 4 gram weight 6 in the toe surface 11 and a 4 gram weigh 6 in the heel surface 14) or two different weights 6 may be used at the same time. For example, if a user wishes to have a toe-weighted putter 2, then a golfer may screw a 10 gram weight 6 into the threaded aperture 15 of the toe surface 11 and screw a 6 gram weight 6 into the threaded aperture 15 of the heel surface 14. Or, as another example, the golfer may use a 12 gram weight 6 in the toe surface 11 and use no weight 6 (or an extremely light plastic weight 6) in the heel surface 14. If the golfer wishes to have a heel-weighted putter 2, then the golfer may use a 10 gram weight 6 in the aperture 15 of the heel surface 11 and use a 6 gram weight 6 in the aperture 15 of the toe surface 14. The weight of the putter 2 would therefore be completely customizable for the golfer.

When in use, the user may place the golf ball at the bottom of his/her stroke and line up the ball aiming symbol 13 with the golf ball. When the putter head 4 strikes the golf ball, it strikes above the equator/center of the golf ball causing topspin to roll the golf ball more accurately, longer, and without lofting. The higher center of gravity of the putter 2 striking the golf ball above its equator/center also contributes to more topspin and force imposed on the golf ball upon impact. Accordingly, the golfer will see that the putter 2 of the present invention will not only create immediate topspin, but it will help prevent lofting of the golf ball and will cause the golf ball to roll farther and more accurately than the positive lofted golf putters used today.

While the embodiments of the disclosure have been described in terms of various specific embodiments, those skilled in the art will recognize that the embodiments of the disclosure may be practiced with modifications within the spirit and scope of the claims.

I claim:

1. A golf putter head comprising:

a planar top surface;

a base;

two ball striking surfaces with a negative loft angle measured with respect to the base;

a toe surface with a negative loft angle measured with respect to the base;

a heel surface with a negative loft angle measured with respect to the base;

at least one threaded horizontal aperture within one of the toe surface and the heel surface of the golf putter head; and at least one threaded weight for insertion into the at least one threaded horizontal aperture;

wherein each of the two ball striking surfaces, the toe surface, and the heel surface have a trapezoidal shape;

wherein the golf putter head has a center of gravity at a point above a center of a height of the golf putter head; and wherein the threaded weight adjusts the center of gravity of the putter head laterally while maintaining the center of gravity of the putter head at the point above the center of the height of the putter head.

2. The golf putter head of claim 1 wherein the toe surface and the heel surface have the same negative loft angle.

3. The golf putter head of claim 1 wherein the two ball striking surfaces have the same negative loft angle.

4. The putter head of claim 1 wherein the at least one threaded aperture is left empty.

5. The putter head of claim 1 wherein the putter head may be used for right handed and left handed putting.

6. A golf putter head comprising:

a planar top surface;

a base;

two ball striking surfaces, each having with respect to the base a loft angle between −1° and −4°;

a toe surface having with respect to the base a loft angle between −20° and −35°;

a heel surface having with respect to the base a loft angle between −20° and −35°;

a threaded horizontal aperture within the toe surface of the putter head and a threaded horizontal aperture within the heel surface of the golf putter head; and a threaded weight inserted into the threaded horizontal aperture within the toe surface of the putter head and another threaded weight inserted into the threaded horizontal aperture within the heel surface of the putter head;

wherein the golf putter head has a center of gravity at a point above a center of a height of the golf putter head; and wherein the threaded weights adjust the center of gravity of the putter head laterally while maintaining the center of gravity of the putter head at the point above the center of the height of the putter head.

7. The golf putter head of claim 6 wherein the toe surface and the heel surface have the same negative loft angle.

8. The golf putter head of claim 6 wherein the two ball striking surfaces have the same negative loft angle.

9. The putter head of claim 6 wherein the threaded weight within the toe surface of the putter head and the threaded weight within the heel surface of the putter head are equal in weight.

10. The putter head of claim 6 wherein the threaded weight within the toe surface of the putter head is heavier than the threaded weight within the heel surface of the putter head, causing the putter head to be toe-weighted.

11. The putter head of claim 6 wherein the threaded weight within the heel surface of the putter head is heavier than the threaded weight within the toe surface of the putter head, causing the putter head to be heel-weighted.

12. A golf putter head comprising:

a planar top surface;

a base;

two ball striking surfaces, each having with respect to the base a loft angle between −1° and −4°;

a toe surface having with respect to the base a loft angle between −20° and −35°;

a heel surface having with respect to the base a loft angle between −20° and −35°;

a threaded horizontal aperture within the toe surface for receiving a threaded weight;

a threaded horizontal aperture within the heel surface for receiving a threaded weight; and at least one threaded weight for insertion into at least one of the threaded horizontal aperture within the toe surface of the putter head and the threaded horizontal aperture within the heel surface of the putter head;

wherein the golf putter head has a center of gravity at a point above a center of a height of the golf putter head; and wherein the threaded weight adjusts the center of gravity of the putter head laterally while maintaining the center of gravity of the putter head at the point above the center of the height of the putter head.

13. The golf putter head of claim 12 wherein the toe surface and the heel surface have a loft angle of −30° and wherein the ball striking surfaces each have a loft angle of −3° causing the ball striking surface to strike a golf ball to impose immediate topspin on the golf ball without lofting the golf ball upon impact.

* * * * *